US012654073B2

(12) United States Patent
Zimmerman et al.

(10) Patent No.: US 12,654,073 B2
(45) Date of Patent: Jun. 16, 2026

(54) MODULAR GOLF CLUB HEAD INCLUDING A WEIGHT ASSEMBLY HAVING ADJUSTABLE COMPONENTS

(71) Applicant: Acushnet Company, Fairhaven, MA (US)

(72) Inventors: Gery M. Zimmerman, Fallbrook, CA (US); Joshua D. Westrum, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 315 days.

(21) Appl. No.: 18/483,715

(22) Filed: Oct. 10, 2023

(65) Prior Publication Data

US 2025/0114669 A1 Apr. 10, 2025

(51) Int. Cl.
*A63B 53/04* (2015.01)

(52) U.S. Cl.
CPC ..... *A63B 53/04* (2013.01); *A63B 2053/0491* (2013.01)

(58) Field of Classification Search
CPC ..... A63B 2053/0491; A63B 2053/0495
See application file for complete search history.

(56) References Cited

U.S. PATENT DOCUMENTS

| | | | | |
|---|---|---|---|---|
| 6,015,354 | A | 1/2000 | Ahn | |
| 7,108,609 | B2 * | 9/2006 | Stites | A63B 53/06 473/335 |
| 10,981,039 | B1 | 4/2021 | Ripp | |
| 12,350,560 | B1 * | 7/2025 | Evans | A63B 53/0466 |
| 2007/0099720 | A1 * | 5/2007 | Gillig | A63B 53/0466 473/324 |

* cited by examiner

*Primary Examiner* — Raeann Gorden
(74) *Attorney, Agent, or Firm* — Mike S. Kim

(57) ABSTRACT

A modular golf club head with an improved weight assembly is disclosed herein. In accordance with the presently disclosed technology, the golf club head may include a body. The body may include a face, a back, and a cavity. The modular golf club head may include a weight assembly that includes a vertical track, a movable weight installable within the vertical track and movable therein, and an adjustable clamp.

18 Claims, 13 Drawing Sheets

MODULAR GOLF CLUB HEAD INCLUDING A WEIGHT ASSEMBLY HAVING ADJUSTABLE COMPONENTS

FIELD OF THE DISCLOSURE

The present disclosure generally relates to golf clubs, and more specifically to a modular golf club including a weight assembly having adjustable components.

SUMMARY

Embodiments of the presently disclosed technology may include modular golf clubs. In accordance with some aspects of the presently disclosed technology, a modular golf club head may include a body. The body may include a face, a back extending rearward from at least a part of the face, and a cavity between the face and the back. The modular golf club head may include a weight assembly within the cavity. The weight assembly may include a vertical track extending from a top of the body to a bottom of the body, a movable weight installable within the vertical track and movable therein, and an adjustable clamp to secure the movable weight to a discrete selectable position along the vertical track. The adjustable clamp may clamp in a direction perpendicular to a vertical direction on the vertical track.

In embodiments, the vertical track may include notches to provide discrete selectable positions for the movable weight along the vertical track. The movable weight may include a protrusion to engage the notches to help fix the movable weight into the discrete selectable positions.

In embodiments, the vertical track may include a first track corner having a first track angle measured from a y-axis toward an x-axis and a second track corner having a second track angle measured from the y-axis toward the x-axis.

In embodiments, the first track angle is about 90 degrees, and wherein the second track angle is about 30 degrees.

In embodiments, the movable weight may include a first weight corner to engage the first track corner and a second weight corner to engage the second track corner. The first weight corner may have a first weight angle measured from the y-axis toward the x-axis, and the second weight corner may have a second weight angle measured from the y-axis toward the x-axis.

In embodiments, the first weight angle is about 30 degrees, and wherein the second weight angle is about 30 degrees.

In embodiments, the adjustable clamp may be a pivoting clamp.

In embodiments, the weight assembly may further include a fastener to fasten the movable weight into the discrete selectable position. The fastener may include a fastener axis that is perpendicular to the vertical direction.

In embodiments, the adjustable clamp may wrap around a rearward end of the vertical track. The adjustable clamp may include a clamping end to fit on a heelward side of the vertical track. The vertical track may include an opening to receive the clamping end.

In embodiments, the weight assembly may further include a fastener to fasten the movable weight into the discrete selectable position. The fastener may directly engage a part of the movable weight to fasten the movable weight into the discrete selectable position. The adjustable clamp may include a clamping through hole to receive the fastener.

In embodiments, the adjustable clamp may include a clamping through hole to receive a fastener and a clamping end to engage the movable weight.

In embodiments, the vertical track may include an opening to receive at least a portion of the clamping end to secure the movable weight into the discrete selectable position by fastening the fastener.

In accordance with some aspects of the presently disclosed technology, a modular golf club head may include a body. The body may include a face, a back extending rearward from at least a part of the face, and a cavity between the face and the back. The modular golf club head may include a weight assembly. The weight assembly may include a vertical track extending from a top of the body to a bottom of the body. The vertical track may include an opening. The weight assembly may include a movable weight installable within the vertical track and movable therein. The weight assembly may further include an adjustable clamp to secure the movable weight to a discrete selectable position along the vertical track. The adjustable clamp may wrap around a rearward end of the vertical track. The adjustable clamp may include a clamping through hole to receive a fastener and a clamping end to engage a part of the movable weight to secure the movable weight into the discrete selectable position along the vertical track. The weight assembly may also include the fastener to secure the adjustable clamp.

In embodiments, the adjustable clamp may clamp in a direction perpendicular to a vertical direction on the vertical track.

In embodiments, a fastener axis may be perpendicular to a vertical direction of the vertical track.

In embodiments, the body may further include a toe. The toe may include a toe through hole to receive the fastener.

In accordance with some aspects of the presently disclosed technology, a modular golf club head may include a body. The body may include a face, a back extending rearward from at least a part of the face, and a cavity between the face and the back. The modular golf club head may include a weight assembly. The weight assembly may include a vertical track extending from a top of the body to a bottom of the body. The vertical track may include an opening. The weight assembly may include a movable weight installable within the vertical track and movable therein. The weight assembly may further include an adjustable clamp to secure the movable weight to a discrete selectable position along the vertical track. The adjustable clamp may include a clamping through hole and a clamping end to engage the movable weight. The weight assembly may also include a fastener to secure the movable weight into the discrete selectable position. The opening may receive at least a portion of the clamping end to secure the movable weight into the discrete selectable position by fastening the fastener In embodiments, the adjustable clamp may clamp in a direction perpendicular to a vertical direction on the vertical track.

In embodiments, a fastener axis may be perpendicular to a vertical direction of the vertical track.

In embodiments, the body may further include a toe. The toe may include a toe through hole to receive the fastener.

Figure 1:
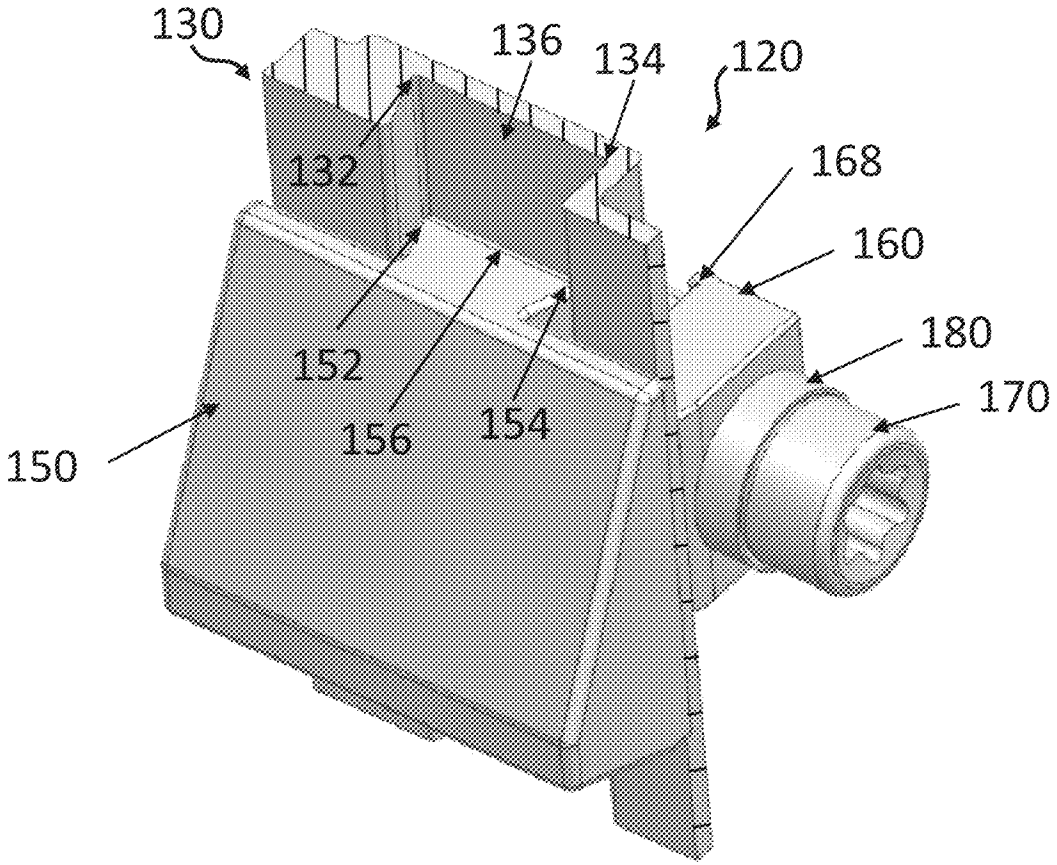
FIG. 1 is a perspective view of a weight assembly in accordance with one or more embodiments of the presently disclosed technology.

These and other features of the presently disclosed technology, as well as the methods of operation and functions of the related elements of structure and the combination of parts, may be clearer upon consideration of the following detailed description and the claims with reference to these drawings, all of which form a part of this specification, with like reference numerals designating corresponding parts in the various figures. It is to be expressly understood that these drawings are for illustration purposes and description and are not intended to be limiting. It should be noted that for clarity and ease of illustration these drawings are not necessarily made to scale. As used in the specification and in the claims, the singular form of "a", "an", and "the" may include plural referents unless the context clearly dictates otherwise.

DETAILED DESCRIPTION

The flight of a golf ball may be dependent on a number of factors, including, but not limited to, the swing of a golf club striking the golf ball, and the golf club itself. For example, how the golf club is designed may impact fades, draws, launch angles, ball spin, and/or speed. By adjusting one or more design properties of the golf club, the flight of the golf ball can be affected, thereby increasing golf club performance. For example, adjusting a center of gravity (CG) and/or a moment of inertia (MOI) of a golf club head may impact the flight of the golf ball. This may be accomplished through adjustable weighting. However, these adjustable weights need to be both securely attached to the golf club head and selectively movable. As such, improvements to adjustable weight assemblies for golf club heads are desired.

The presently disclosed technology described herein contemplates a golf club head, such as an iron, a fairway wood, a driver, or another type of golf club head, that includes a weight assembly with adjustable components. The weight and weight distribution of the golf club head can improve flight characteristics of the golf ball, thereby increasing golf club performance. The weight assembly may enable the CG and/or MOI of the golf club head to be adjusted through selectively movable weights that can impact the flight characteristics of the golf ball, including, for example, fades, draws, higher or lower launch angles, more or less ball spin, and/or more or less speed. The weight assembly may allow for adjustable swing weight of the golf club head (e.g., increasing or decreasing the weight of the club head).

The presently disclosed technologies may provide a modular golf club head with a weight assembly within a cavity in the body of the modular golf club head. The weight assembly may include a vertical track, a movable weight installable within the vertical track and movable therein, and an adjustable clamp to secure the movable weight. By selectively moving the weight, the flight of the golf ball may be impacted. For example, moving the weight up or down the vertical track may affect launch angles and ball spin. This movable configuration may allow for the CG, MOI, and/or swing weight of the golf club head to be finely tuned. The presently disclosed technology may be designed to increase security of the movable weight within the vertical track and reduce undesirable rattling or movement during the golf club swing. The presently disclosed technology may also allow for the weight to be adjusted quickly and easily. In some embodiments, this may be accomplished without fully detaching a component from the golf club head, thereby reducing lost or misplaced components.

Establishing a reference coordinate system for the presently disclosed technology, an x-axis may refer to the axis that is horizontal to the face from a heel to toe direction, a y-axis may refer to the vertical axis through the club in a crown to sole direction, a z-axis may refer to the horizontal axis that is horizontal front to back in a forward and rear direction. Alternatively speaking, the x-axis may be defined as a horizontal axis tangent to a geometric center of the face with the positive direction towards a heel of the golf club head, a y-axis is a vertical axis orthogonal to the x-axis with a positive direction towards a top of the golf club head, and a z-axis being orthogonal to both the x-axis and the y-axis with a positive direction towards a front of the golf club head. The x-y-z coordinate system described above shall be the same for all subsequent discussions. For example, the x-y-z coordinate system may be used to describe the CG of the golf club head. The golf club head may have a CG-x, a CG-y, and a CG-z component corresponding to the x-, y-, and z-coordinates discussed herein.

Figure 2:
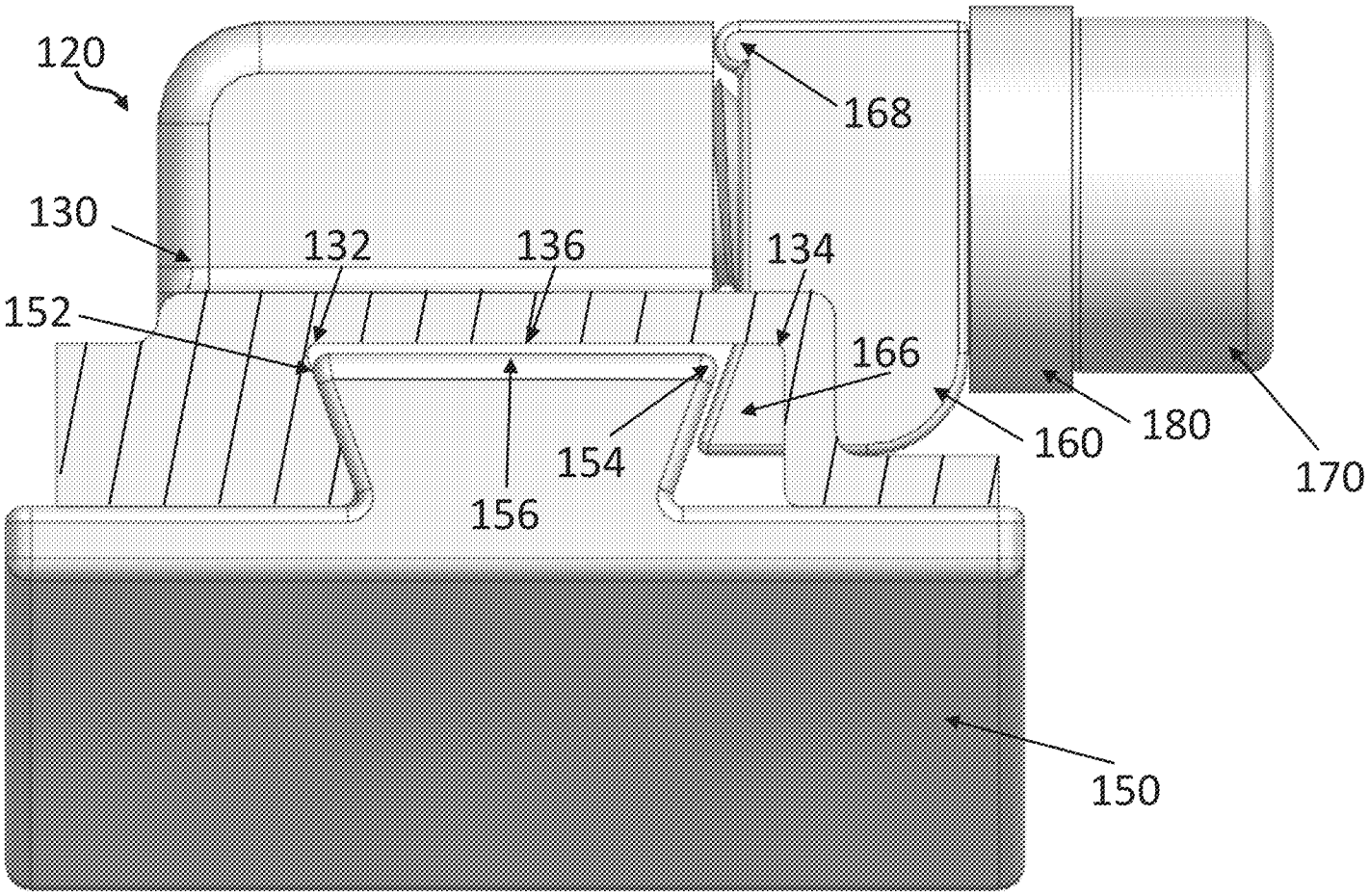
FIG. 2 is a top-down view of a weight assembly in accordance with one or more embodiments of the presently disclosed technology.
Figure 3:
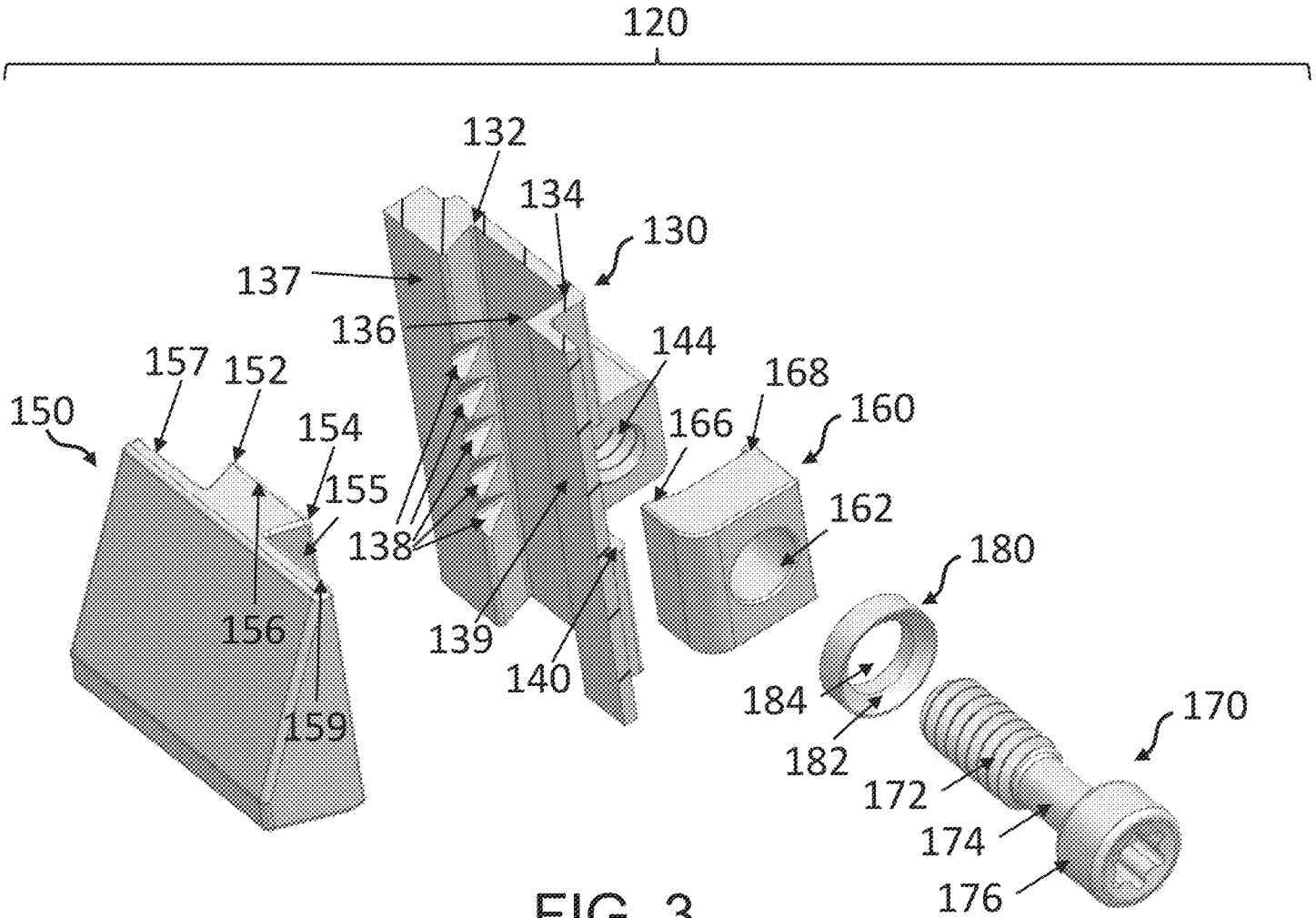
FIG. 3 is a perspective exploded view of a weight assembly in accordance with one or more embodiments of the presently disclosed technology.
Figure 4:
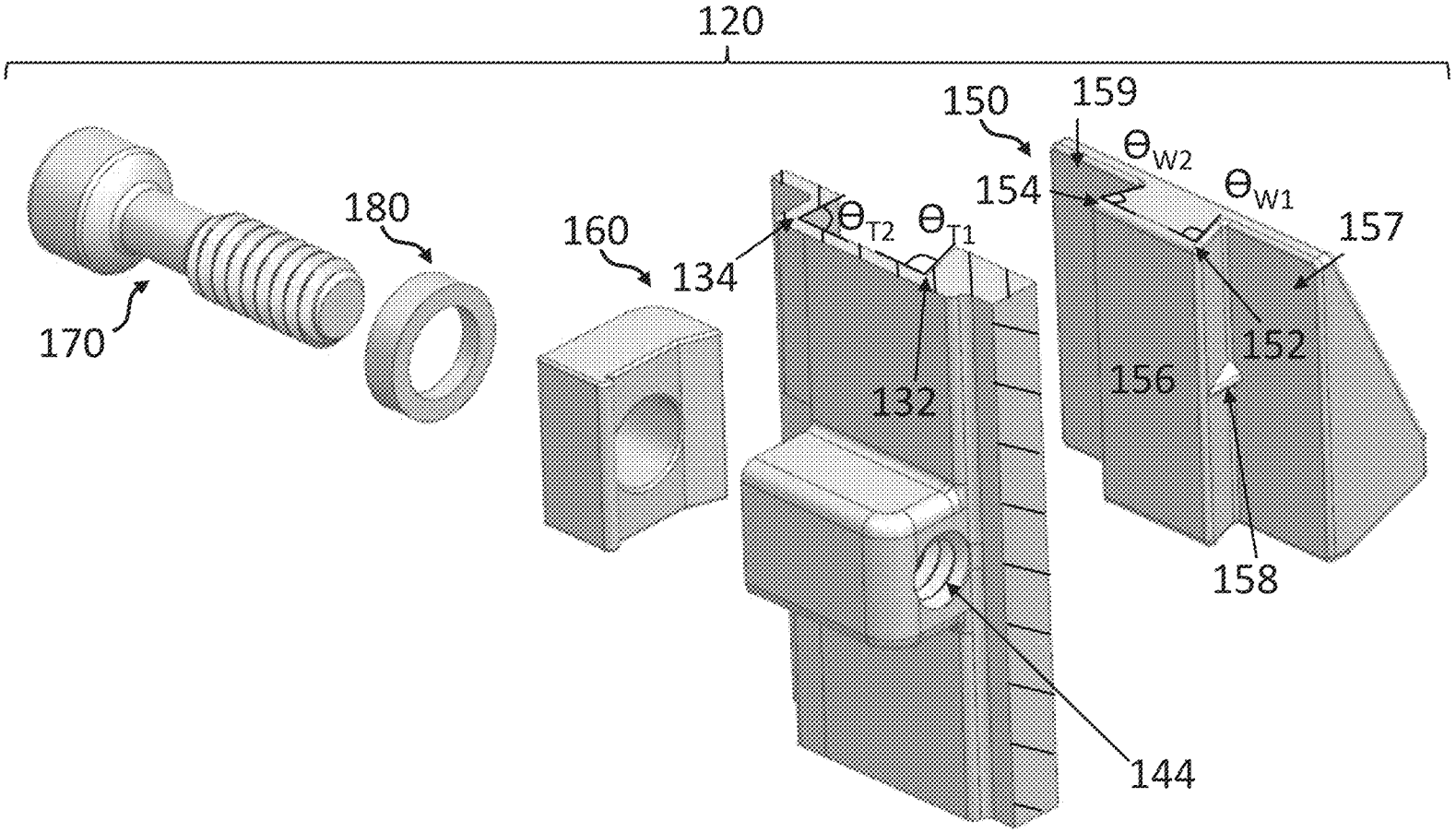
FIG. 4 is a perspective exploded view of a weight assembly in accordance with one or more embodiments of the presently disclosed technology.

FIGS. 1-4 illustrate a weight assembly in accordance with one or more embodiments of the presently disclosed technology. For example, FIG. 1 illustrates a perspective view of a weight assembly in accordance with one or more embodiments of the presently disclosed technology. FIG. 2 illustrates a top-down view of a weight assembly in accordance with one or more embodiments of the presently disclosed technology. FIG. 3 illustrates a perspective exploded view of a weight assembly in accordance with one or more embodiments of the presently disclosed technology. FIG. 4 illustrates a perspective exploded view of a weight assembly in accordance with one or more embodiments of the presently disclosed technology. Each of these figures provide different views of the same or similar components, and may be discussed together herein. Referring first to FIG. 1, weight assembly 120 may include vertical track 130, movable weight 150, adjustable clamp 160, fastener 170, and washer 180. Weight assembly 120 may be used to house and selectively move movable weight 150. Weight assembly 120 may be positioned, integrated, or otherwise located within cavity (at least shown as cavity 516 in FIG. 5) of golf club head (at least shown as golf club head 500 in FIG. 5). In some embodiments, weight assembly 120 may be located toeward of golf club head (at least shown as golf club head 500 in FIG. 5). It should be appreciated that weight assembly 120 may be located elsewhere within cavity (at least shown as cavity 516 in FIG. 5) without departing from the spirit and scope of the presently disclosed technology. It should be appreciated that one or more components of weight assembly 120 may be exposed to an outside environment without departing from the spirit and scope of the presently disclosed technology. For example, fastener head 176 may be exposed and appear as part of the external surface of modular golf club head (at least shown as golf club head 500 in FIG. 5).

Vertical track 130 may include first track corner 132, second track corner 134, channel 136, first vertical track surface (at least shown as first vertical track surface 137 in FIG. 3), notches (at least shown as notches 138 in FIG. 3), second vertical track surface (at least shown as second vertical track surface 139 in FIG. 3), opening (at least shown as opening 140 in FIG. 3), and/or clamping through hole (at least shown as clamping through hole 144 in FIG. 3). Vertical track 130 may receive weight 150. Weight 150 may be selectively movable along vertical track 130. For example, fastener 170 may be partially unfastened and golf club head (at least shown as golf club head 500 in FIG. 5) may be flipped vertically to move movable weight 150 up or down. In a new selectable position, fastener 170 may be fastened to secure movable weight 150. It should be appreciated that other methods of selectively moving weight 150 may be used without departing from the spirit and scope of the presently disclosed technology. Vertical track 130 may be within a cavity (at least shown as cavity 516 in FIG. 5) of a golf club head (at least shown as golf club head 500 in FIG. 5). Vertical track 130 may extend from sole (at least shown as sole 506 in FIG. 5) to topline (at least shown as topline 502 in FIG. 5). In some embodiments, vertical track 130 may extend from either sole (at least shown as sole 506 in FIG. 5) or topline (at least shown as topline 502 in FIG. 5) and not touch the opposing side of golf club head (at least shown as golf club head 500 in FIG. 5). Vertical track 130 may be made out of metal, plastic, and/or another material.

Referring to FIG. 4, first track corner 132 may have first track angle $\theta_{T1}$. In embodiments, first track angle $\theta_{T1}$ may be between about 0 degrees and about 90 degrees. In some embodiments, first track angle $\theta_{T1}$ may be between about 15 degrees and 50 degrees. For example, first track angle $\theta_{T1}$ may be about 20 degrees. First track angle $\theta_{T1}$ may be shaped, sized, and/or dimensioned to fit first weight corner 152. Second track corner 134 may have a second track angle $\theta_{T2}$. In embodiments, second track angle $\theta_{T2}$ may be between about 30 degrees and 90 degrees. In some embodiments, second track angle $\theta_{T2}$ may be between about 75 degrees and about 90 degrees. For example, second track angle $\theta_{T2}$ may be about 90 degrees.

Referring back to FIG. 1, channel 136 may run along a height of vertical track 130. The height of vertical track 130 may be based on dimensions of a golf club head (at least shown as golf club head 500 in FIG. 5). For example, the height of vertical track 130 may be the same as a height of cavity (at least shown as cavity 516 in FIG. 5). Vertical track 130 and/or channel 136 may be shaped, sized, and/or dimensioned to receive channel side 156 of weight 150. In a fixed position, channel side 156 of weight 150 may not press against channel 136. Referring to FIG. 3, notches 138 may receive protrusion (at least shown as protrusion 158 in FIG. 4) to help fix the movable weight 150 into discrete selectable positions indexed by notches 138. Notches 138 may be on a side of channel 136 adjacent to first track corner 132. In embodiments, notches 138 may be on the other side or both sides of channel 136. In some embodiments, there may be fewer or more notches 138. Notches 138 may be spaced further apart or closer apart without departing from the spirit and scope of the presently disclosed technology. In some embodiments, there may be a single notch 138 of a larger height with grooves or recessed elements to engage with a corresponding component on weight 150, include, for example, protrusion (at least shown as protrusion 158 in FIG. 4).

First vertical track surface 137 may be a surface of vertical track 130 contacting first weight surface 157 in a fixed, selectable, or discrete position of weight 150. First vertical track surface 137 may be flat or substantially flat or planar. Second vertical track surface 139 may be a surface of vertical track 130 contacting second weight surface 159 in a fixed, selectable, or discrete position of weight 150. Second vertical track surface 139 may be flat or substantially flat or planar. In embodiments, first vertical track surface 137 and second vertical track surface 139 may be angled to help prevent unwanted movement of weight 150 in a fixed position in golf club head (at least shown as golf club head 500 in FIG. 5). First vertical track surface 137 and second vertical track surface 139 may help distribute the force of, and/or help secure, weight 150.

Opening 140 may receive clamping end 166 of adjustable clamp 160. This may allow clamping end 166 to engage weight 150 via weight side wall 155. Opening 140 may be shaped, sized, and/or dimensioned to receive clamping end 166.

Fastener through hole 144 may receive fastener 170. For example, fastener through hole 144 may receive fastener threads 172 of fastener 170. In embodiments, fastener through hole 144 may be threaded. In some embodiments, fastener through hole 144 may go through the entirety of vertical track 130 such that a hole is visible on both sides of vertical track 130, that is, a through hole. In some embodiments, fastener through hole 144 may be a blind hole, that is, fastener through hole 144 may not go through the entirety of vertical track 130 such that a hole is only visible on one side of vertical track 130. In such embodiments, fastener through hole 144 may be differently shaped, sized, and/or dimensioned to provide enough grip for fastener 170. In these embodiments with a blind hole, fastener 170 may be differently shaped, sized, and/or dimensioned to provide enough grip to retain fastener 170, including, for example, more threads, different types of threads, a larger bottom end of fastener 170, and so on.

Referring back to FIG. 4, movable weight 150 may include first weight corner 152, second weight corner 154, weight side wall 155, channel side 156, first weight surface 157, protrusion 158, and/or second weight surface 159. Movable weight 150 may be installable and selectively movable within vertical track 130. Movable weight 150 may be installable and selectively movable within channel 136. In a top-most position, movable weight 150 may increase CG-y compared to a middle position, making the CG more topward. In a bottom-most position, movable weight 150 may decrease CG-y compared to a middle position, making the CG more soleward. Movable weight 150 may be about 1 gram, 2 grams, 5 grams, 10 grams, and so on, including values in between without departing from the spirit and scope of the presently disclosed technology. Movable weight 150 may be made out of metal, plastic, and/or other materials.

First weight corner 152 may have a first weight angle $\theta_{W1}$. In embodiments, first weight angle $\theta_{W1}$ may be between about 10 degrees and about 90 degrees. In some embodiments, first weight angle $\theta_{W1}$ may be between about 15 degrees and 50 degrees. For example, first weight angle $\theta_{W1}$ may be about 20 degrees. First weight corner 152 may correspond to the shape, size, and/or dimension of first track corner 132. Second weight corner 154 may have a second weight angle $\theta_{W2}$. Second weight corner 154 may have a second weight angle $\theta_{W2}$. In embodiments, second weight angle $\theta_{W2}$ may be between about 10 degrees and 90 degrees. In some embodiments, second weight angle $\theta_{W2}$ may be between about 15 degrees and about 50 degrees. For example, second weight angle $\theta_{W2}$ may be about 20 degrees. Example angles discussed herein may be illustrated in at least FIG. 2. In some embodiments, first weight angle $\theta_{W1}$ may be different from second weight angle $\theta_{W2}$.

Weight side wall 155 may engage with clamping end 166. Weight side wall 155 may be angled. In some embodiments, the angle of weight side wall 155 may be between about 10 degrees and 90 degrees. For example, the angle of weight side wall 155 may be at about a 20 degree angle, measured from channel side 156. Weight side wall 155 may be shaped, sized, and/or dimensioned to engage with clamping end 166.

Channel side 156 may run along a height of weight 150. Channel side 156 may be shaped, sized, and/or dimensioned to fit within channel 136. In a fixed, selectable, or discrete position, channel side 156 of weight 150 may not press against channel 136. Protrusion 158 may engage notches 138. This may fix movable weight 150 into discrete or selectable positions indexed by notches 138. While illustrated as triangular, it should be appreciated that protrusion 158 may be differently shaped, sized, and/or dimensioned without departing from the spirit and scope of the presently disclosed technology. For example, there may be a single notch 138 and multiple protrusions 158. As another example, notches 138 and protrusion 158 may be rounded instead of triangular.

Referring to FIG. 3, adjustable clamp 160 may include clamping through hole 162, clamping end 166, and/or clamping protrusion 168. Adjustable clamp 160 may be shaped, sized, and/or dimensioned to be able to engage weight 150 anywhere along channel 136. Clamping through hole 162 may be a through hole. Clamping through hole 162 may not be threaded. In some embodiments, clamping through hole 162 may be threaded. Clamping through hole 162 may receive fastener 170. Clamping end 166 may clamp onto weight 150. Clamping end 166 may be angled or curved to engage weight side wall 155. For example, clamping end 166 may clamp onto weight side wall 155. The angle of clamping end 166 may be complementary to the angle of weight side wall 155. For example, weight side wall 155 may be angled at about 20 degrees and clamping end 166 may be angled at about 70 degrees. Clamping end 166 may clamp in a direction perpendicular to a vertical direction on vertical track 130. Clamping end 166 may push weight 150 against the wall where notches 138 are. In some embodiments, clamping end 166 may push protrusion 158 into one of notches 138. It should be appreciated that clamping end 166 may clamp at a different direction without departing from the spirit and scope of the presently disclosed technology. Clamping protrusion 168 may be on an opposite end of adjustable clamp 160 compared to clamping end 166. For example, clamping protrusion 168 may be on a faceward end of adjustable clamp 160 while clamping end 166 may be on a rearward end of adjustable clamp 160. Clamping protrusion 168 may provide a pivot point for clamping end 166 to engage or clamp with weight 150. Clamping protrusion 168 may have a rounded shape to allow for this pivoting motion. Clamping protrusion 168 may be otherwise shaped, sized, and/or dimensioned without departing from the spirit and scope of the presently disclosed technology. Adjustable clamp 160 may be made out of metal, plastic, composite, and/or another material.

Fastener 170 may include fastener threads 172, fastener shaft 174, and/or fastener head 176. Fastener 170 may fasten or otherwise secure vertical track 130 to adjustable clamp 160 and/or washer 180. Fastening fastener 170 may secure adjustable clamp 160 to weight 150. Fastener threads 172 may be threads on fastener 170. Fastener threads 172 may be on a lower portion of fastener 170. In some embodiments, the entirety of fastener shaft 174 may be threaded. In embodiments, part of fastener shaft 174 may be threaded. Fastener head 176 may be a top of fastener 170. Fastener head 176 may include a star-style head, a hexalobular-style head, a Phillips-style head, a slotted-style head, a hexagonal-style head, a square-style head, and/or other fastener head types without departing from the spirit and scope of the presently disclosed technology. Fastener head 176 may allow a user to fasten or unfasten fastener 170. Fastener head 176 may receive a tool (e.g., screwdriver, golf wrench, and so on) to fasten or unfasten fastener 170. The direction fastener 170 is fastened may be referred to as a fastener axis. The fastener axis may be along or parallel to the x-axis. Fastener 170 may be made out of metal, plastic, composite, and/or another material.

Washer 180 may include recessed portion 182 and/or washer through hole 184. Washer 180 may help distribute the load from fastener 170. Washer 180 may prevent fastener 170 from loosening. Recessed portion 182 may receive a bottom of fastener head 176. In some embodiments, a bottom of fastener head 176 may be shaped, sized, and/or dimensioned to fit into recessed portion 182. For example, a bottom of fastener head 176 may be partially conical with a flat top and bottom. Washer through hole 184 may receive fastener shaft 174. Washer 180 may be made out of metal, plastic, composite, and/or another material.

Figure 5:
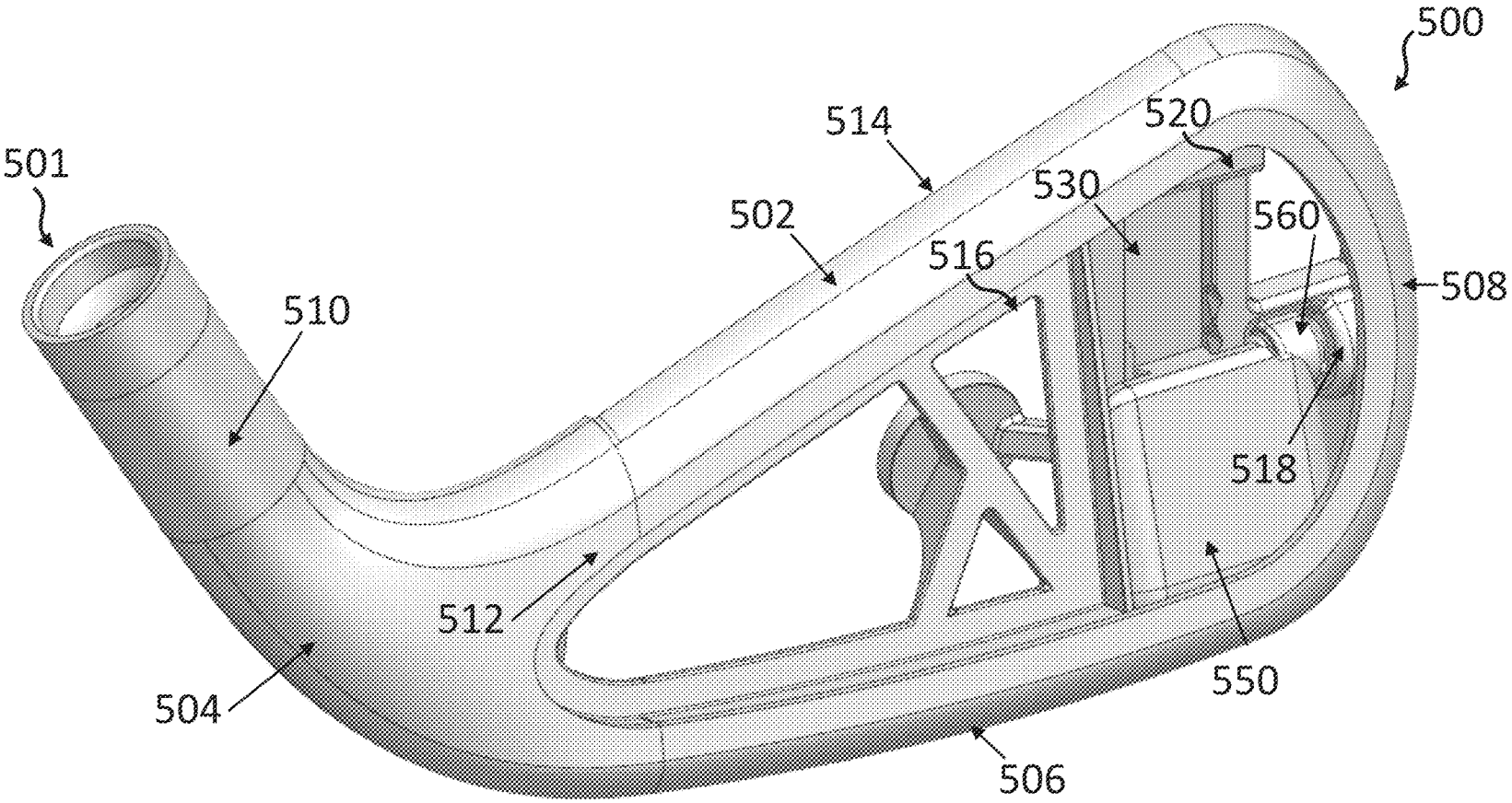
FIG. 5 is a perspective view of a portion of a modular golf club head in accordance with one or more embodiments of the presently disclosed technology.
Figure 6:
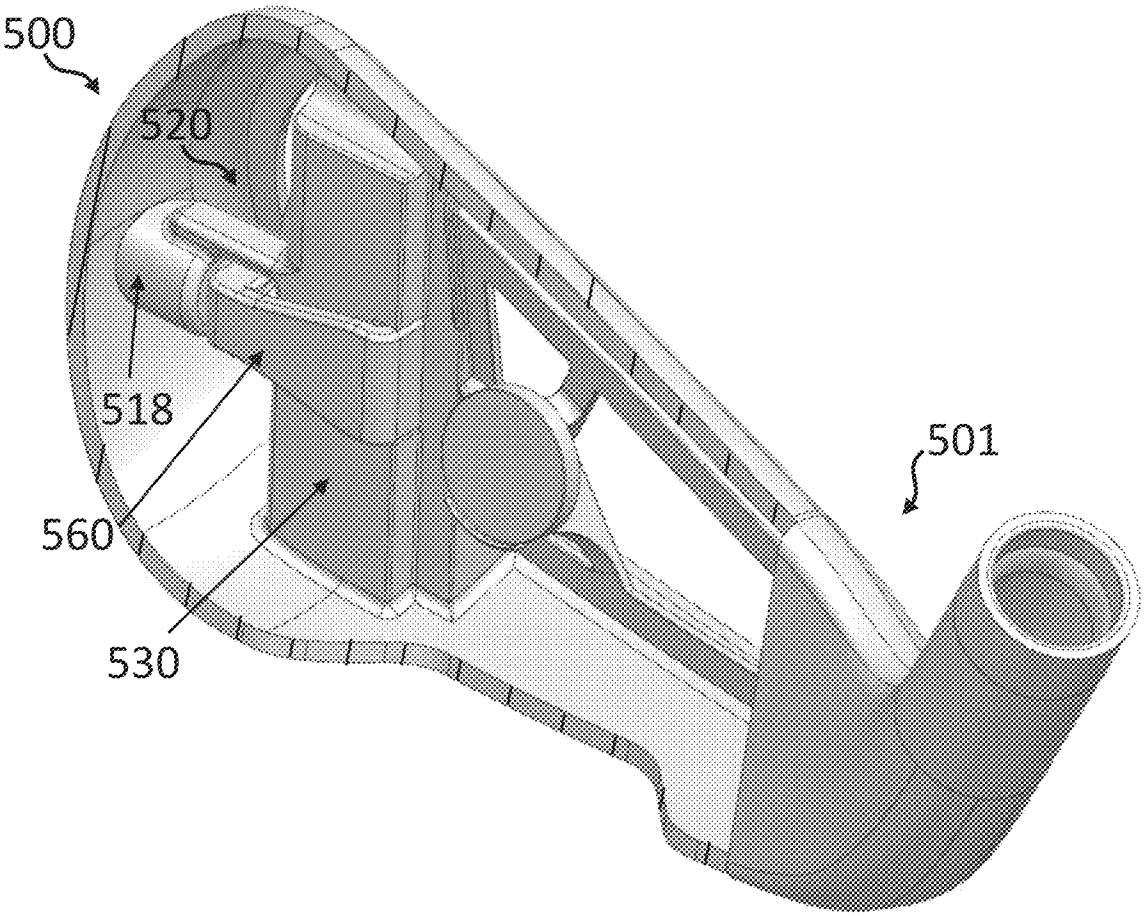
FIG. 6 is a cross-sectional perspective view of a modular golf club head in accordance with one or more embodiments of the presently disclosed technology.
Figure 7:
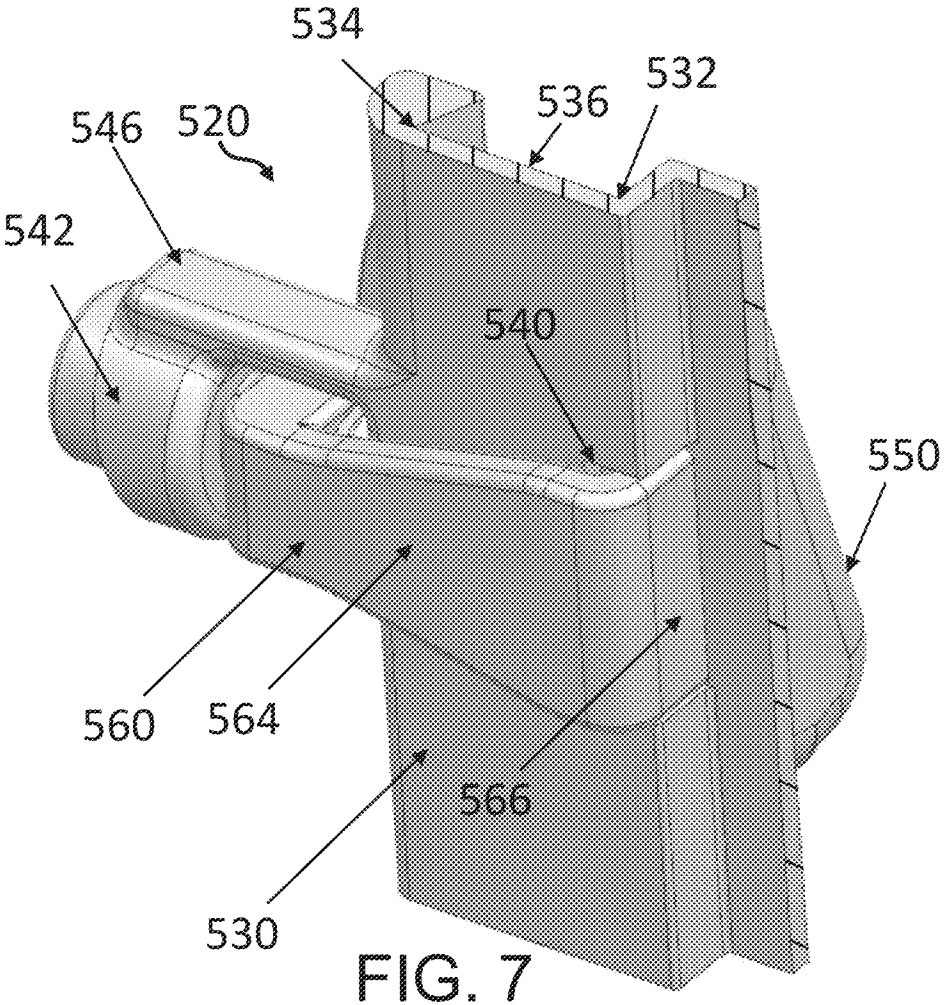
FIG. 7 is a perspective view of a weight assembly in accordance with one or more embodiments of the presently disclosed technology.
Figure 8:
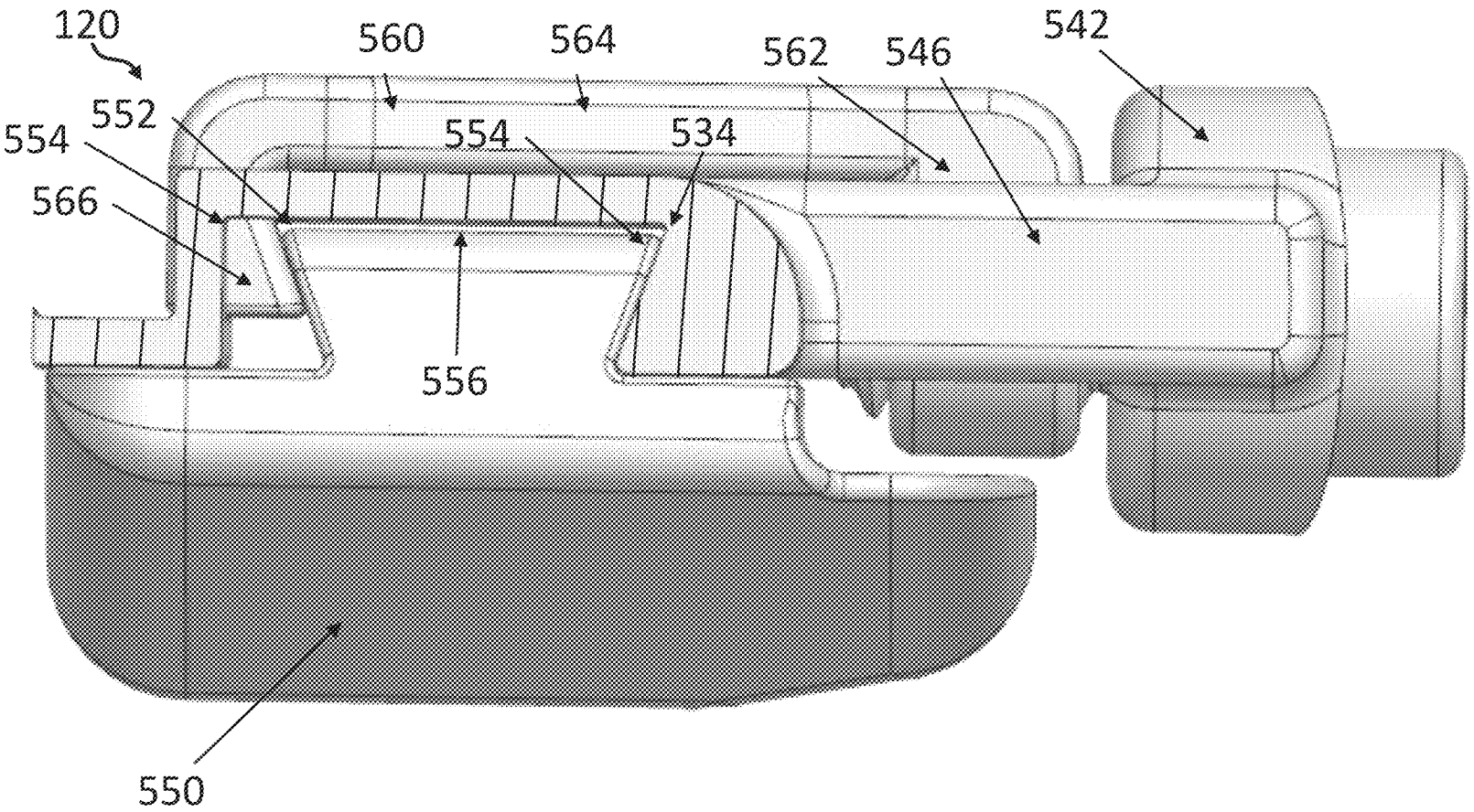
FIG. 8 is a top-down view of a weight assembly in accordance with one or more embodiments of the presently disclosed technology.
Figure 9:
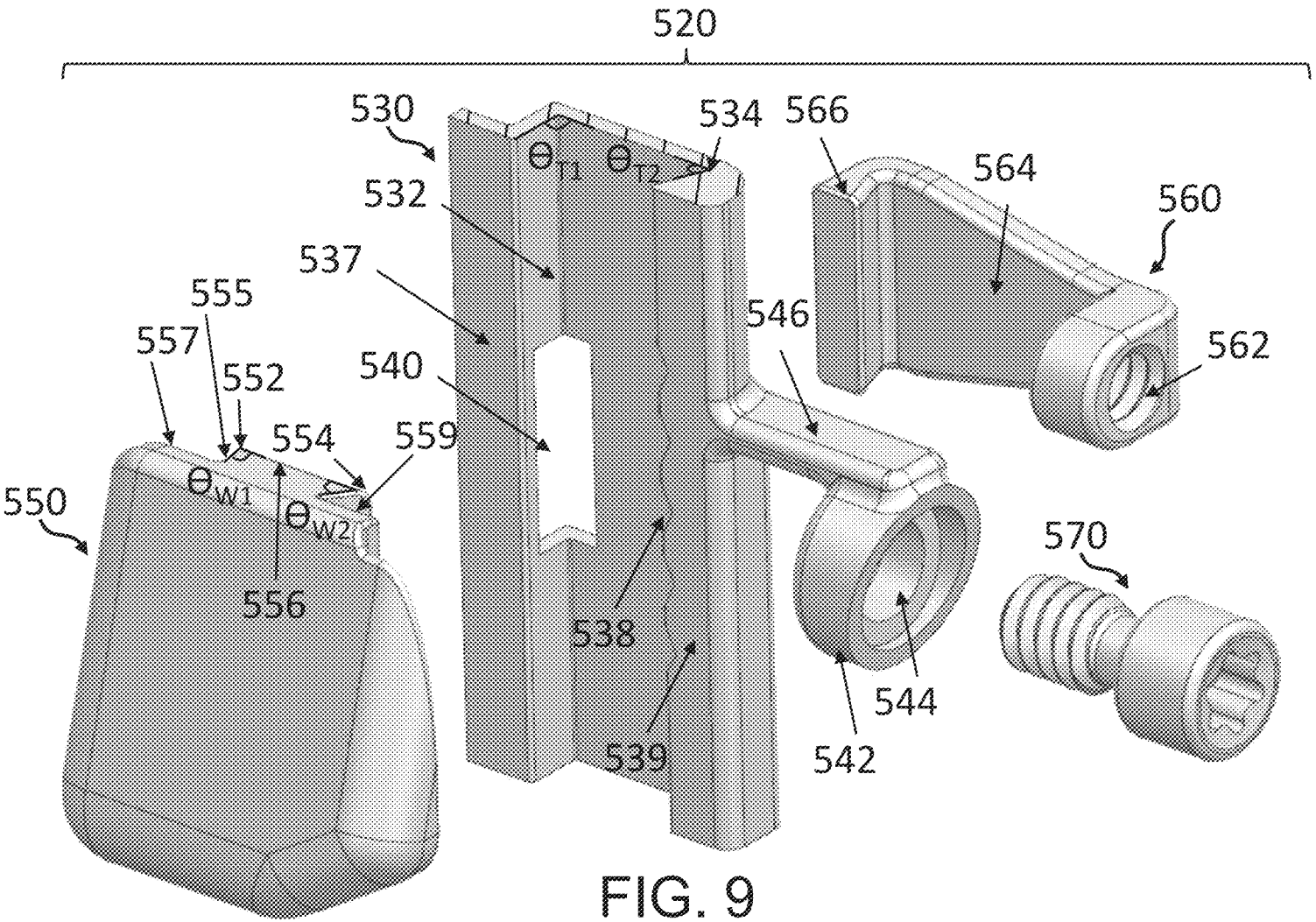
FIG. 9 is a perspective exploded view of a weight assembly in accordance with one or more embodiments of the presently disclosed technology.

FIG. 5 is a perspective view of a portion of a modular golf club head in accordance with one or more embodiments of the presently disclosed technology. FIG. 6 is a cross-sectional perspective view of a modular golf club head in accordance with one or more embodiments of the presently disclosed technology. FIG. 7 is a perspective view of a weight assembly in accordance with one or more embodiments of the presently disclosed technology. FIG. 8 is a top-down view of a weight assembly in accordance with one or more embodiments of the presently disclosed technology. FIG. 9 is a perspective exploded view of a weight assembly in accordance with one or more embodiments of the presently disclosed technology. Each of these figures provide different views of the same or similar components, and may be discussed together herein. Referring to FIG. 5, golf club head 500 may include body 501 including topline 502, heel 504, sole 506, toe 508, hosel 510, back 512, face 514, cavity 516, and/or toe through hole 518. The golf club head may also include weight assembly 520, vertical track 530, weight 550, and/or adjustable clamp 560. In some embodiments, golf club head 500 may be referred to herein as a modular golf club head. Weight assembly 520 may be integrated, coupled, or otherwise incorporated to golf club head 500. As illustrated, vertical track 530 may extend from sole 506 to topline 502.

Topline 502 may refer to a top of golf club head 500. Heel 504 may refer to a heel end of golf club head 500. This may be the region of golf club head 500 that is nearest to a user at address. Sole 506 may refer to a sole or bottom of golf club head 500. Toe 508 may refer to a toe end of golf club head 500. This may be the region of golf club head 500 that is furthest from a user at address. Hosel 510 may refer to a hollow section of golf club head 500 where a shaft (not shown) is inserted. Back 512 may refer to a back of golf club head 500. Face 514 may refer to a front of golf club head 500. This may include a surface intended to strike a golf ball. Cavity 516 may refer to a cavity between back 512 and face 514. Weight assembly 520 may be located within cavity 516. Toe through hole 518 may be a through hole through toe 508. Toe through hole 518 may receive fastener 570. Herein, faceward or frontward may mean toward a face of golf club head 500, rearward or backward may mean toward a rear of golf club head 500, toeward may mean toward a toe of golf club head 500, heelward may mean toward a heel of golf club head 500, upward or topward may mean toward a top of golf club head 500, downward, soleward, or bottomward may mean toward a bottom of golf club head 500.

Weight assembly 520 may include vertical track 530, weight 550, and/or adjustable clamp 560. Weight assembly 520 may include components to selectively adjust weight 550 along vertical track 530.

Referring to FIG. 9, vertical track 530 may include first track corner 532, second track corner 534, channel 536, first vertical track surface 537, notches 538, second vertical track surface 539, opening 540, fastener shelf 542, fastener through hole 544, and/or through hole arm 546. These components may be the same as, or substantially similar to, channel 136, first vertical track surface 137, and/or second vertical track surface 139 in FIGS. 1-4. First track corner 532 may have first track angle $\theta_{T1}$. In embodiments, first track angle $\theta_{T1}$ may be between about 45 degrees and 90 degrees. In some embodiments, first track angle $\theta_{T1}$ may be between about 75 degrees and about 90 degrees. For example, first track angle $\theta_{T1}$ may be about 90 degrees. Second track corner 534 may have a second track angle θ12. In embodiments, second track angle $\theta_{T2}$ may be between about 10 degrees and about 80 degrees. In some embodiments, second track angle $\theta_{T2}$ may be between about 55 degrees and 50 degrees. For example, second track angle $\theta_{T2}$ may be about 20 degrees. Example angles discussed herein may be illustrated in at least FIG. 8.

Notches 538 may be along a wall adjacent to second track corner 534 and adjacent to second vertical track surface 539. Opening 540 may be on first track corner 532. Opening 540 may receive clamping end 566 of adjustable clamp 560. Opening 540 may be shaped, sized, and/or dimensioned to receive clamping end 566. Fastener shelf 542 may include fastener through hole 544. Fastener shelf 542 may receive fastener 570. Fastener shelf 542 may help stabilize fastener 570 and/or weight assembly 520. Fastener shelf 542 may help align fastener 570. Fastener shelf 542 may be integrated, coupled, or otherwise secured to golf club head. Part of fastener shelf 542 may be exposed to an external surface of golf club head 500. In some embodiments, this part of fastener shelf 542 may be flush with toe 508. Fastener shelf 542 may be shaped, sized, and/or dimensioned to fit within the toe through hole (at least shown as toe through hole 1009 in FIG. 10) of golf club head 500. In embodiments, the fastener head may be flush with the toe through hole (at least shown as toe through hole 1009 in FIG. 10) of golf club head 500. Fastener shelf 542 may include a recessed portion. The recessed portion may include fastener through hole 544. The recessed portion may help fastener head remain flush with an external surface of golf club head 500. In some embodiments, the recessed portion may help fastener head be recessed within the external surface of golf club head 500.

Fastener through hole 544 may receive fastener 570. For example, fastener through hole 544 may receive a fastener shaft. In embodiments, fastener through hole 544 may be threaded. In some embodiments, fastener through hole 544 may go through the entirety of vertical track 530 such that a hole is visible on both sides of vertical track 530, that is, it may be a through hole. Fastener through hole 544 may be aligned with toe through hole 518.

Through hole arm 546 may extend a surface adjacent from second vertical track surface 539. This may provide alignment for fastener 570. Through hole arm 546 may help stabilize vertical track 530, adjustable clamp 560, and/or fastener 570. In embodiments, through hole arm 546 may be shaped, sized, and/or dimensioned to fit with adjustable clamp 560. For example, clamping through hole 562 may fit below through hole arm 546.

Movable weight 550 may include first weight corner 552, second weight corner 554, weight side wall 555, channel side 556, first weight surface 557, a protrusion, and/or second weight surface 559. These components may be the same as, or substantially similar to, first weight corner 152, second weight corner 154, weight side wall 155, channel side 156, first weight surface 157, protrusion 158, and/or second weight surface 159 in in FIGS. 1-4. The protrusion may be on second weight surface 559. The protrusion may engage notches 538. This may fix movable weight 550 into discrete selectable positions indexed by notches 538.

Adjustable clamp 560 may include clamping through hole 562, clamping arm 564, and/or clamping end 566. These components may be the same as, or substantially similar to, clamping through hole 162 and/or clamping end 166. Clamping through hole 562 may fit between a body of vertical track 530 and through hole arm 546, Clamping end 566 may engage weight 550 through opening 540. Clamping arm 564 may wrap around behind vertical track 530. This is shown in at least FIGS. 6 and 7. In embodiments, clamping arm 564 may be shaped, sized, and/or dimensioned to fit around a back of vertical track 530 to allow for clamping end 566 to go through opening 540 and engage weight 550 at weight side wall 555.

Fastener 570 may be the same as, or substantially similar to, fastener 170.

Figure 10:
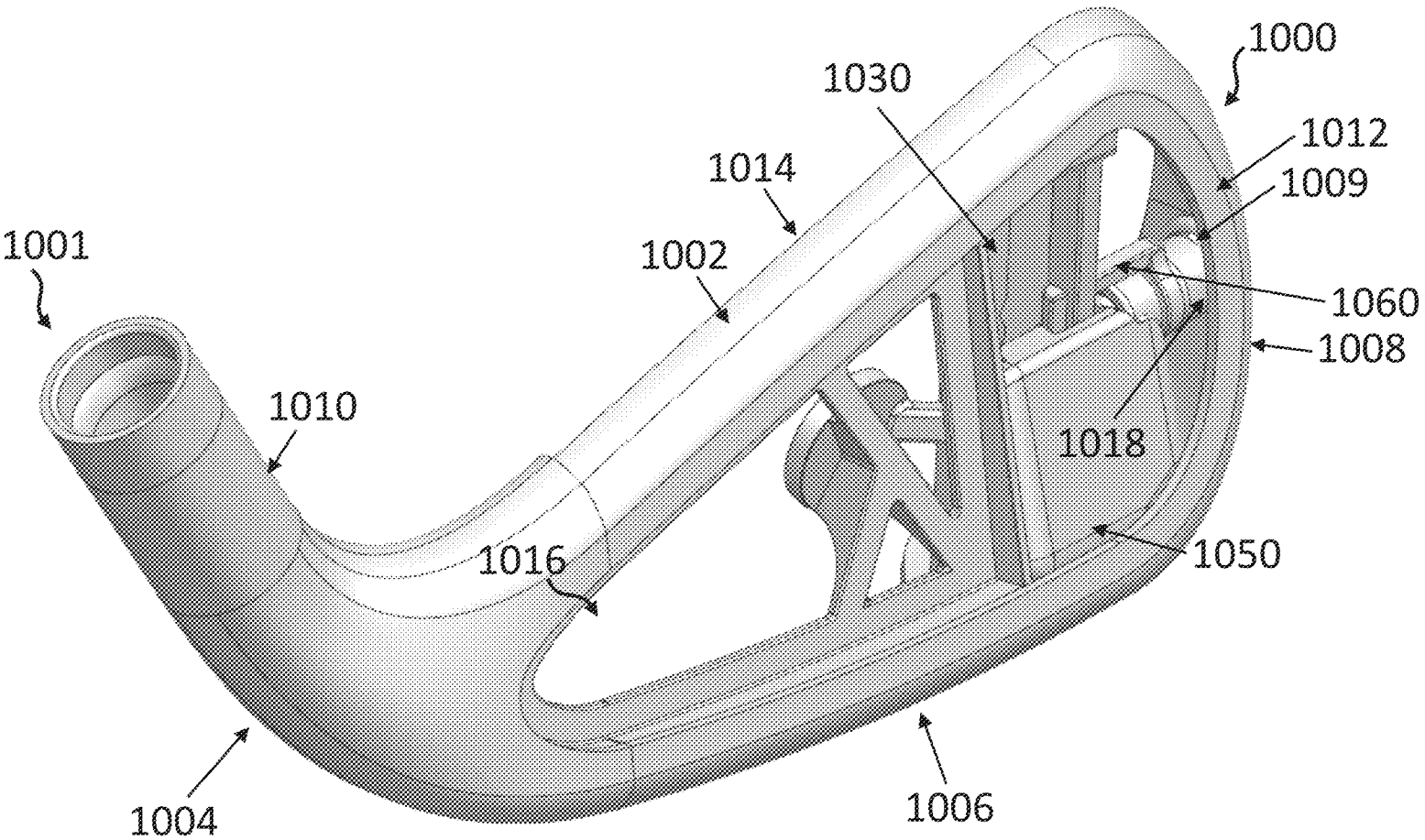
FIG. 10 is a perspective view of a modular golf club head in accordance with one or more embodiments of the presently disclosed technology.
Figure 11:
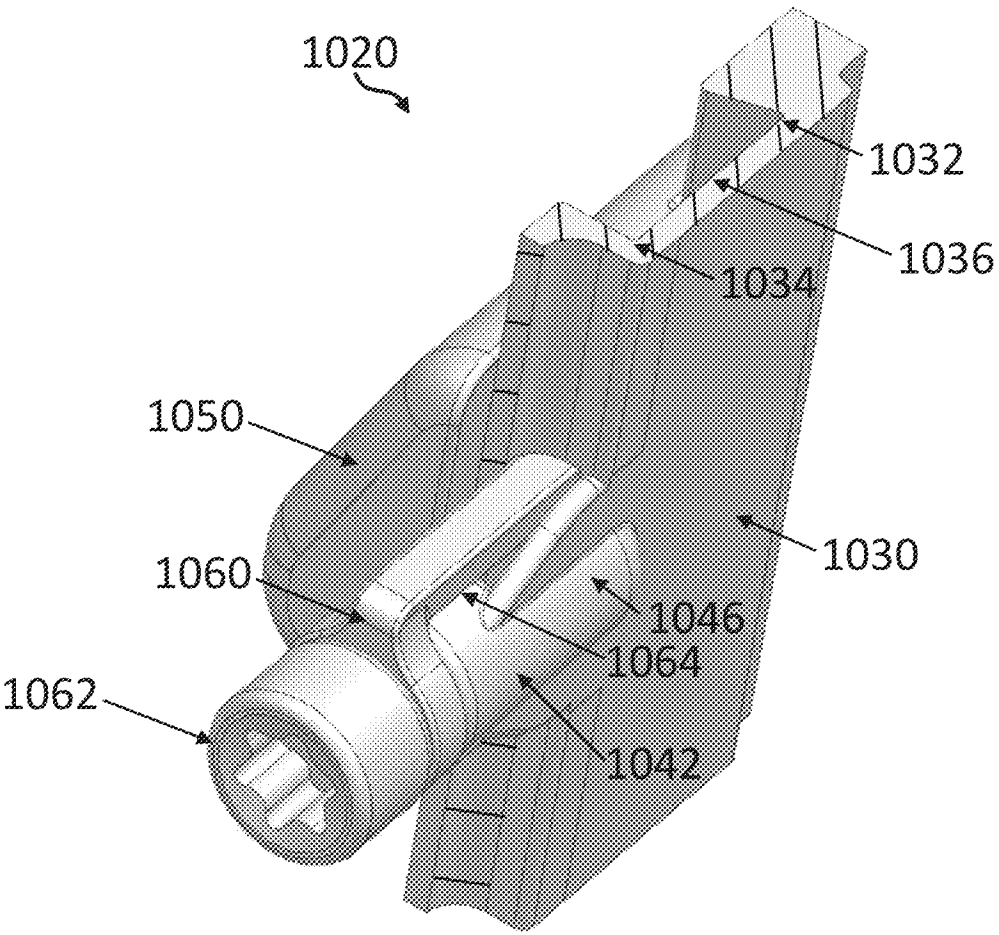
FIG. 11 is a perspective view of a weight assembly in accordance with one or more embodiments of the presently disclosed technology.
Figure 12:
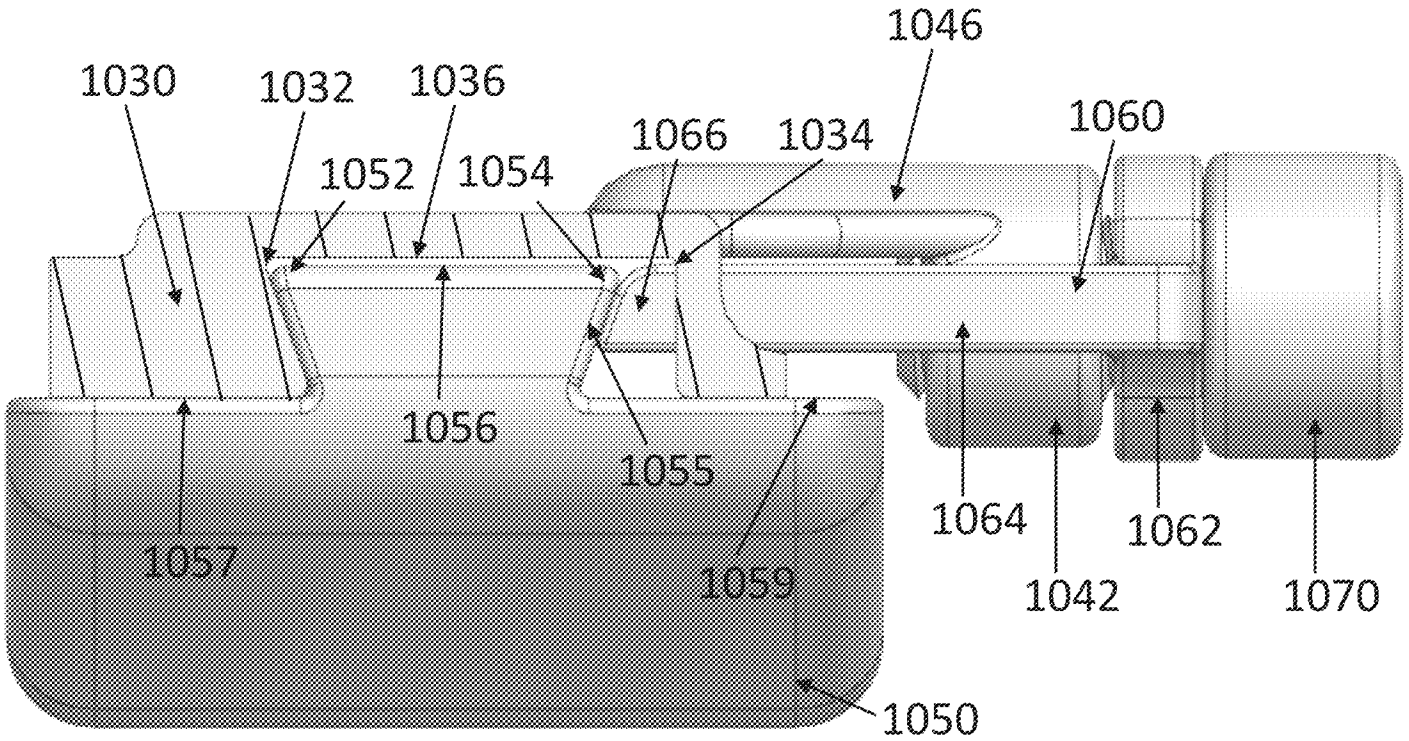
FIG. 12 is a top-down view of a weight assembly in accordance with one or more embodiments of the presently disclosed technology.
Figure 13:
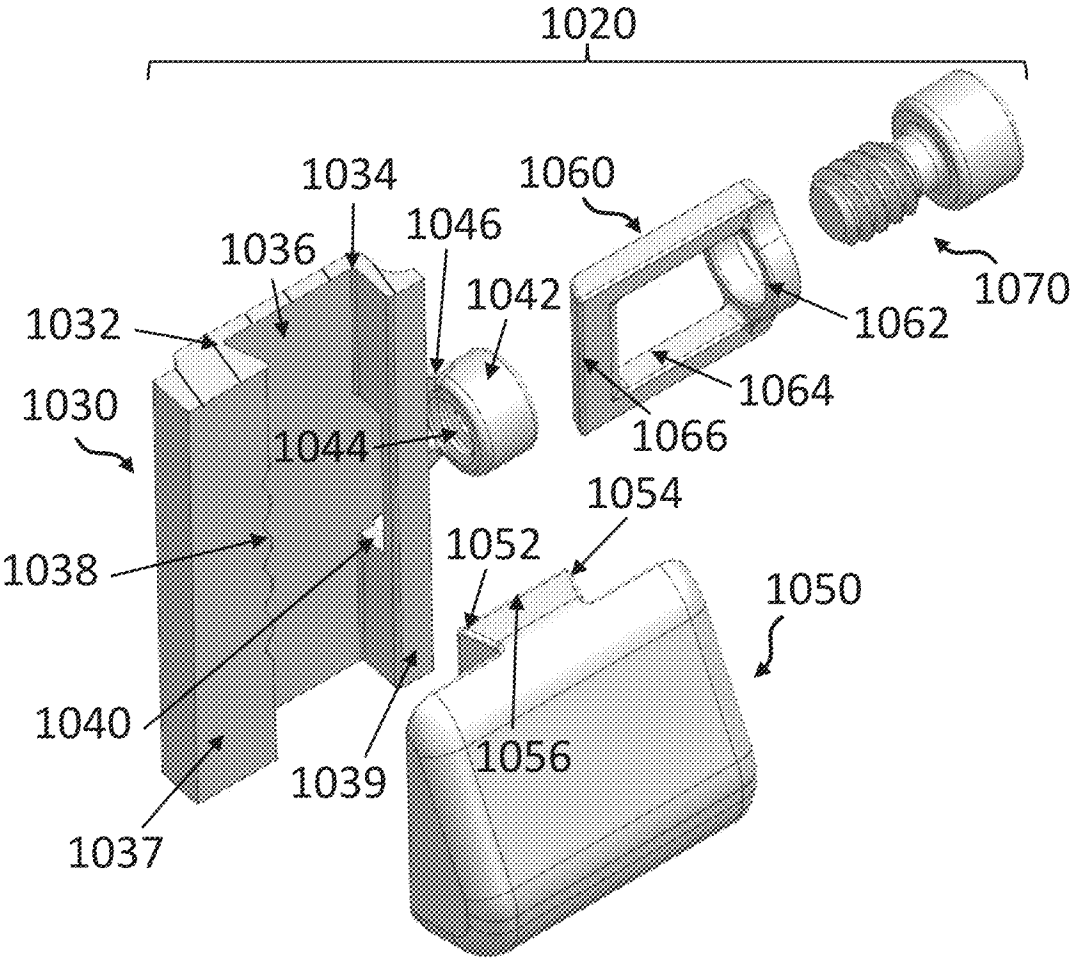
FIG. 13 is a perspective exploded view of a weight assembly in accordance with one or more embodiments of the presently disclosed technology.

FIG. 10 is a perspective view of a modular golf club head in accordance with one or more embodiments of the presently disclosed technology. FIG. 11 is a perspective view of a weight assembly in accordance with one or more embodiments of the presently disclosed technology. FIG. 12 is a top-down view of a weight assembly in accordance with one or more embodiments of the presently disclosed technology. FIG. 13 is a perspective exploded view of a weight assembly in accordance with one or more embodiments of the presently disclosed technology. Each of these figures provide different views of the same or similar components, and may be discussed together herein. Referring to FIG. 10, golf club head 1000 may include body 1001 including topline 1002, heel 1004, sole 1006, toe 1008, hosel 1010, back 1012, face 1014, cavity 1016, and/or toe through hole 1018. Golf club head 1000 may also include weight assembly 1020, vertical track 1030, weight 1050, and/or adjustable clamp 1060. Body 1001 including topline 1002, heel 1004, sole 1006, toe 1008, hosel 1010, back 1012, face 1014, cavity 1016 may be the same as, or substantially similar to, body 501 including topline 502, heel 504, sole 506, toe 508, hosel 510, back 512, face 514, and/or cavity 516. Toe through hole 1009 may receive fastener 1070. Toe through hole 1009 may be shaped, sized, and/or dimensioned to receive fastener 1070.

Weight assembly 1020 may include vertical track 1030, weight 1050, and/or adjustable clamp 1060. Vertical track 1030 may be the same as, or substantially similar to, vertical track 130. Referring to FIG. 13, vertical track 1030 may include first track corner 1032, second track corner 1034, channel 1036, first vertical track surface 1037, notches 1038, second vertical track surface 1039, opening 1040, and/or fastener through hole 1044. These components may be the same as, or substantially similar to, first track corner 132, second track corner 134, channel 136, first vertical track surface 137, notches 138, second vertical track surface 139, opening 140, and/or fastener through hole 144 in FIGS. 1-4.

Referring to FIG. 12, fastener shelf 1042 may help stabilize fastener 1070 and/or weight assembly 1020. Fastener shelf 1042 may be coupled or connected to a back of vertical track 1030 via through hole arm 1046. This connection on the back may be visible in at least FIGS. 11 and 12. This may allow for adjustable clamp 1060 to enter through opening 1040. Fastener shelf 1042 may include fastener through hole 1044. Fastener shelf 1042 may receive fastener 1070. Fastener shelf 1042 may help stabilize fastener 1070 and/or weight assembly 1020. Fastener shelf 1042 may help align fastener 1070. Fastener shelf 1042 may be integrated, coupled, or otherwise secured to golf club head 1000. Part of fastener shelf 1042 may be exposed to an external surface of golf club head 1000. In embodiments, the fastener head may be flush with the toe through hole (at least shown as toe through hole 1009 in FIG. 10) of golf club head 1000. In some embodiments, fastener shelf 1042 may include a recessed portion. The recessed portion may help fastener head remain flush with an external surface of golf club head 1000. In some embodiments, the recessed portion may help fastener head be recessed within the external surface of golf club head 1000.

Through hole arm 1046 may extend from a body of vertical track 1030. Through hole arm 1046 may provide structural rigidity to adjustable clamp 1060. Through hole arm 1046 may wrap around a back of a body of vertical track 130. Through hole arm 1046 may protrude faceward from vertical track 130 and extend toeward until fastener shelf 1042. Through hole arm 1046 may provide stability to vertical track 1030, adjustable clamp 1060, and/or fastener 1070. It should be appreciated that through hole arm 1046 may be otherwise shaped, sized, and/or dimensioned without departing from the spirit and scope of the presently disclosed technology.

Movable weight 1050 may include first weight corner 1052, second weight corner 1054, weight side wall 1055, channel side 1056, first weight surface 1057, protrusion, and/or second weight surface 1059. These components may be the same as, or substantially similar to, first weight corner 152, second weight corner 154, weight side wall 155, channel side 156, first weight surface 157, protrusion 158, and/or second weight surface 159 in in FIGS. 1-4.

Adjustable clamp 1060 may include clamping through hole 1062, clamping arm 1064, and/or clamping end 1066. Clamping through hole 1062 and clamping end 1066 may be the same as, or substantially similar to, clamping through hole 562 and clamping end 166. In some embodiments, the material surrounding clamping through hole 1062 may be differently shaped, sized, and/or dimensioned without departing from the spirit and scope of the presently disclosed technology. For example, the material surrounding clamping through hole 1062 may be thinner or shorter than clamping through hole 562. Clamping through hole 1062 may receive fastener 170. Clamping through hole 1062 may not be threaded. In some embodiments, clamping through hole 1062 may be threaded. Clamping through hole 1062 may be sandwiched between fastener head and fastener shelf 1042. Adjustable clamp 1060 may be made out of metal, plastic, composite, and/or another material. Clamping arms 1064 may be on a top and a bottom of adjustable clamp 1060. Clamping arms 1064 may extend from clamping through hole 1062 to clamping end 1066. Clamping arm 1064 may provide structural rigidity to adjustable clamp 1060. An opening between clamping arms 1064 may reduce the weight of adjustable clamp 1060. In some embodiments, there may be no opening and material may extend between clamping arms 1064, such that it appears solid.

Fastener 1070 may be the same as, or substantially similar to, fastener 170.

Other than in at least some of the operating examples, or unless otherwise expressly specified, all of the numerical ranges, amounts, values and percentages such as those for amounts of materials, moment of inertias, center of gravity locations, loft, angles, various ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and appended claims are approximations that may vary depending upon the desired properties sought to be obtained by the presently disclosed technology. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the presently disclosed technology are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While various embodiments of the disclosed technology have been described above, it should be appreciated these are examples only, and not limiting. Likewise, the various figures may depict an example configuration or structure to aid in understanding the features and functionality that can be included in the disclosed technology. The presently disclosed technology is not intended to be restricted to the illustrated example configurations and structures, and the desired features can be implemented with a variety of alternative configurations and structures. It may be apparent to one of skill in the art how alternative embodiments can be implemented to impart the desired features of the presently disclosed technology. Therefore, it will be understood that the appended claims are intended to cover all such modifications and embodiments, which would come within the spirit and scope of the presently disclosed technology.

While the presently disclosed technology may be described herein in terms of various exemplary embodiments, it should be understood that the various features described in any individual embodiment is not limited to its particular embodiment, and can be applied, whether alone or in combinations with features of other embodiments, to another embodiment, whether or not such an embodiment is described herein or described as part of a single embodiment. Thus, the breadth and scope of the presently disclosed technology should not be limited to any of the above-described exemplary embodiments.

Words, phrases, and their variations that are used herein, unless otherwise expressly stated, should be construed as open ended, not as limiting. For example, the term "include" should be read to mean "include, without limitation"; the term "example" should be read to mean the following provides exemplary instances, not an exhaustive or limiting list thereof; "a" or "an" should be read as meaning "at least one," "one or more" etc.; and "traditional," "normal," and similar terms should not be construed as limiting to a given time period, but should be read to encompass traditional, normal, like technologies that may be known now or at any future point. In addition, references herein to technologies that would be apparent or known to one of ordinary skill in the art includes such technologies that are apparent or known to one of ordinary skill in the art now or at any time in the future.

The presence of words and phrases such as "one or more," "at least," "not limited to," or other similar phrases shall not be read to necessarily mean that the narrower case is intended in instances where such broadening phrases may be absent. The presence of words such as "first," "second," or other similar words shall not be read to mean that there can only be one or two elements.

What is claimed is:

1. A modular golf club head comprising:

a body comprising:

a face;

a back extending rearward from at least a part of the face; and a cavity between the face and the back;

a toe comprising a toe through hole to receive a fastener; and a weight assembly within the cavity comprising:

a vertical track extending from a top of the body to a bottom of the body;

a movable weight installable within the vertical track and movable therein; and an adjustable clamp to secure the movable weight to a discrete selectable position along the vertical track, wherein the adjustable clamp clamps in a direction perpendicular to a vertical direction on the vertical track.

2. The modular golf club head of claim 1, wherein the vertical track comprises notches to provide discrete selectable positions for the movable weight along the vertical track, and wherein the movable weight comprises a protrusion to engage the notches to help fix the movable weight into the discrete selectable positions.

3. The modular golf club head of claim 1, wherein the vertical track comprises:

a first track corner having a first track angle measured from a y-axis toward an x-axis; and a second track corner having a second track angle measured from the y-axis toward the x-axis.

4. The modular golf club head of claim 3, wherein the first track angle is about 90 degrees, and wherein the second track angle is about 30 degrees.

5. The modular golf club head of claim 3, wherein the movable weight comprises:

a first weight corner to engage the first track corner, wherein the first weight corner has a first weight angle measured from the y-axis toward the x-axis; and a second weight corner to engage the second track corner, wherein the second weight corner has a second weight angle measured from the y-axis toward the x-axis.

6. The modular golf club head of claim 5, wherein the first weight angle is about 30 degrees, and wherein the second weight angle is about 30 degrees.

7. The modular golf club head of claim 1, wherein the adjustable clamp comprises a clamping protrusion providing a pivot point for the adjustable clamp to engage the movable weight.

8. The modular golf club head of claim 1, wherein the weight assembly further comprises a fastener to fasten the movable weight into the discrete selectable position, wherein the fastener comprises a fastener axis that is perpendicular to the vertical direction.

9. The modular golf club head of claim 1, wherein the adjustable clamp wraps around a rearward end of the vertical track, and wherein the adjustable clamp comprises a clamping end to fit on a heelward side of the vertical track, and wherein the vertical track comprises an opening to receive the clamping end.

10. The modular golf club head of claim 9, wherein the weight assembly further comprises a fastener to fasten the movable weight into the discrete selectable position, wherein the fastener directly engages a part of the movable weight to fasten the movable weight into the discrete selectable position, and wherein the adjustable clamp comprises a clamping through hole to receive the fastener.

11. The modular golf club head of claim 1, wherein the adjustable clamp comprises:

a clamping through hole to receive a fastener; and a clamping end to engage the movable weight.

12. The modular golf club head of claim 11, wherein the vertical track comprises an opening to receive at least a portion of the clamping end to secure the movable weight into the discrete selectable position by fastening the fastener.

13. A modular golf club head comprising:

a body comprising:

a face; and a back extending rearward from at least a part of the face; and a cavity between the face and the back;

a toe comprising a toe through hole to receive a fastener; and a weight assembly comprising:

a vertical track extending from a top of the body to a bottom of the body, wherein the vertical track comprises an opening;

a movable weight installable within the vertical track and movable therein;

an adjustable clamp to secure the movable weight to a discrete selectable position along the vertical track, wherein the adjustable clamp wraps around a rearward end of the vertical track, and wherein the adjustable clamp comprises:

a clamping through hole to receive the fastener; and a clamping end to engage a part of the movable weight to secure the movable weight into the discrete selectable position along the vertical track; and the fastener to secure the adjustable clamp.

14. The modular golf club head of claim 13, wherein the adjustable clamp clamps in a direction perpendicular to a vertical direction on the vertical track.

15. The modular golf club head of claim 13, wherein a fastener axis is perpendicular to a vertical direction of the vertical track.

16. A modular golf club head comprising:

a body comprising:

a face;

a back extending rearward from at least a part of the face; and a cavity between the face and the back;

a toe comprising a toe through hole to receive a fastener; and a weight assembly comprising:

a vertical track extending from a top of the body to a bottom of the body, wherein the vertical track comprises an opening;

a movable weight installable within the vertical track and movable therein, wherein the movable weight is movable along the vertical track;

an adjustable clamp to secure the movable weight to a discrete selectable position along the vertical track, wherein the adjustable clamp comprises:

a clamping through hole; and a clamping end to engage the movable weight; and a fastener to secure the movable weight into the discrete selectable position;

wherein the opening receives at least a portion of the clamping end to secure the movable weight into the discrete selectable position by fastening the fastener.

17. The modular golf club head of claim 16, wherein the adjustable clamp clamps in a direction perpendicular to a vertical direction on the vertical track.

18. The modular golf club head of claim 16, wherein a fastener axis is perpendicular to a vertical direction of the vertical track.

* * * * *